US008451080B2

(12) United States Patent
Lee et al.

(10) Patent No.: US 8,451,080 B2
(45) Date of Patent: May 28, 2013

(54) MAGNETIC FIELD FOCUSING FOR ACTUATOR APPLICATIONS

(75) Inventors: Jaewook Lee, Ann Arbor, MI (US); Debasish Banerjee, Ann Arbor, MI (US); Hideo Iizuka, Ann Arbor, MI (US); Ercan Mehmet Dede, Ann Arbor, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 114 days.

(21) Appl. No.: 13/028,609

(22) Filed: Feb. 16, 2011

(65) Prior Publication Data

US 2012/0206226 A1 Aug. 16, 2012

(51) Int. Cl.
*H01F 3/00* (2006.01)
*H01F 7/08* (2006.01)

(52) U.S. Cl.
USPC ..... 335/281; 335/297; 335/229; 335/236; 335/244; 335/296; 335/304

(58) Field of Classification Search
USPC ..... 335/281, 297, 229, 236, 243–244, 335/296, 304
See application file for complete search history.

(56) References Cited

U.S. PATENT DOCUMENTS 1,161,819 A * 11/1915 Grob ..... 335/266
1,768,907 A * 7/1930 Heinkel ..... 335/281
1,817,763 A * 8/1931 Purington ..... 335/267
1,834,431 A * 12/1931 Smith ..... 335/225
2,540,022 A * 1/1951 Rabenda ..... 335/266
2,859,298 A * 11/1958 Burch ..... 335/236
3,281,739 A * 10/1966 Grengg ..... 335/229
4,216,454 A 8/1980 Ohtani et al.
4,327,345 A 4/1982 Kelso et al.
4,381,490 A * 4/1983 Peters ..... 335/210
4,651,118 A 3/1987 Zeuner et al.
4,656,231 A 4/1987 Tieszen et al.
5,138,291 A 8/1992 Day
5,239,277 A 8/1993 Vielot
5,608,369 A 3/1997 Irgens et al.
5,781,090 A * 7/1998 Goloff et al. ..... 335/276
5,886,605 A 3/1999 Ulerich et al.
5,890,662 A 4/1999 Dykstra
5,955,934 A * 9/1999 Raj ..... 335/277
5,969,589 A * 10/1999 Raj ..... 335/277

(Continued)

OTHER PUBLICATIONS

Lee et al., "Topology optimization of switched reluctance motors for the desired torque profile," Struct Multidisc Optim, 42: 783-796 (2010).

(Continued)

*Primary Examiner* — Mohamad Musleh
(74) *Attorney, Agent, or Firm* — Gifford, Krass, Sprinkle, Anderson & Citkowski, P.C.

(57) ABSTRACT

The magnetic force between the electromagnet and plunger of a magnetic actuator, the electromagnet including a coil generating magnetic flux when the coil is energized, can be increased by locating a near field plate on the electromagnet. The near field plate has a spatially modulated surface reactance configured to focus the magnetic flux within a region of the plunger, such as the central portion of an end portion of the plunger proximate the electromagnet, so as to increase the magnetic force between the electromagnet and plunger. Examples also include permanent magnet based actuators and the use of other magnetic field focusing devices.

17 Claims, 7 Drawing Sheets

U.S. PATENT DOCUMENTS

| | | | | |
|---|---|---|---|---|
| 6,501,359 | B2 | 12/2002 | Matsusaka et al. | |
| 6,731,191 | B2 * | 5/2004 | Lang et al. | 335/255 |
| 7,014,168 | B2 | 3/2006 | Shimura et al. | |
| 7,182,051 | B2 * | 2/2007 | Sedda et al. | 123/90.11 |
| 7,205,685 | B2 | 4/2007 | Reichert et al. | |
| 7,350,763 | B2 | 4/2008 | Hofling | |
| 7,511,597 | B2 * | 3/2009 | Sata et al. | 335/220 |
| 7,661,653 | B2 | 2/2010 | Kondoh | |
| 7,710,225 | B2 | 5/2010 | Uni | |
| 7,982,567 | B2 * | 7/2011 | Cartier Millon et al. | 335/229 |
| 8,013,698 | B2 * | 9/2011 | Bonjean et al. | 335/229 |
| 2002/0057153 | A1 | 5/2002 | Matsusaka et al. | |
| 2006/0086396 | A1 | 4/2006 | Ando | |
| 2006/0272714 | A1 | 12/2006 | Carrillo et al. | |
| 2007/0152790 | A1 | 7/2007 | Telep | |
| 2007/0267922 | A1 | 11/2007 | Uni | |
| 2008/0276889 | A1 * | 11/2008 | Sfaxi et al. | 123/90.11 |
| 2009/0021334 | A1 | 1/2009 | Okada | |
| 2009/0065615 | A1 | 3/2009 | Mizui et al. | |
| 2009/0303154 | A1 | 12/2009 | Grbic et al. | |
| 2010/0282223 | A1 | 11/2010 | Czimmek et al. | |

OTHER PUBLICATIONS

A. Grbic, R. Merlin, "Near-field focusing plates and their design," IEEE Transactions on Antennas and Propagation, vol. 56, 2008.

* cited by examiner

FIG. 2B
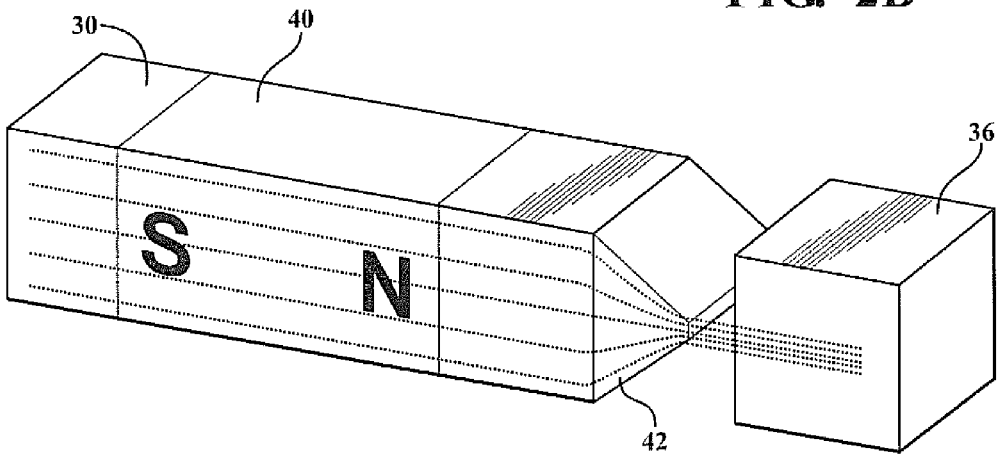
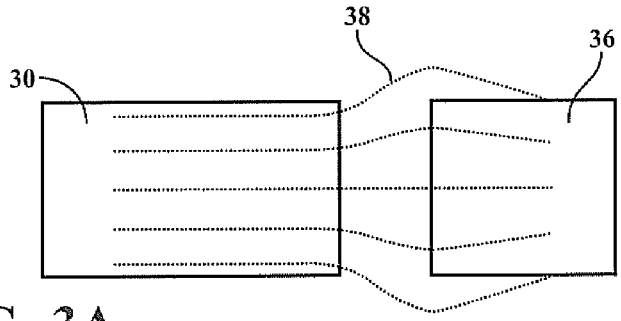
FIG. 3A
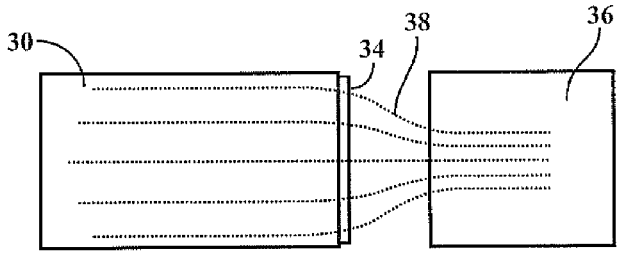
FIG. 3B

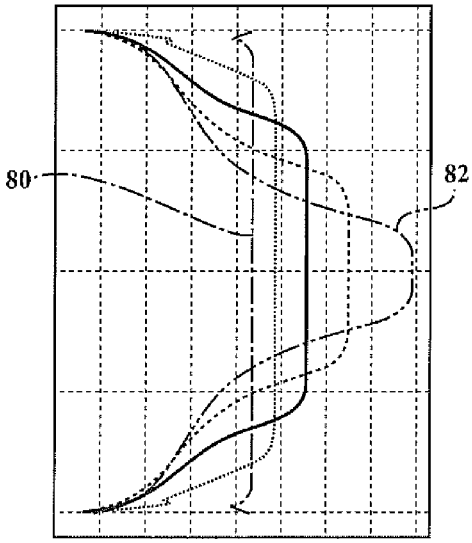
FIG. 9A
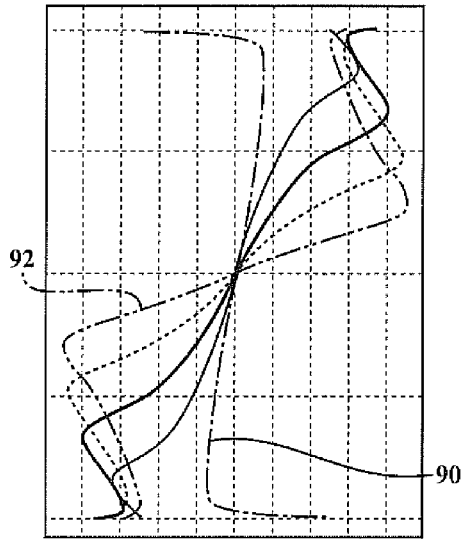
FIG. 9B
FIG. 10
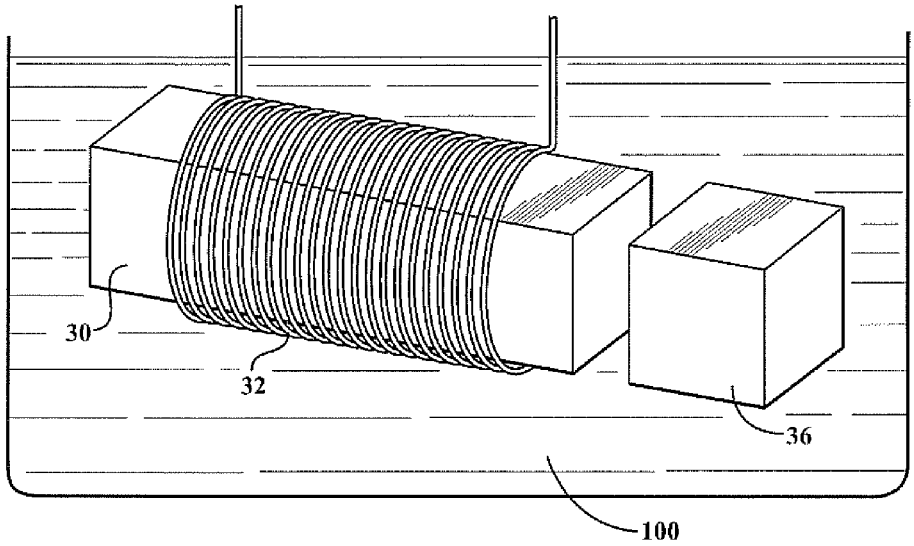

MAGNETIC FIELD FOCUSING FOR ACTUATOR APPLICATIONS

FIELD OF THE INVENTION

The invention relates to magnetic devices such as actuators.

BACKGROUND OF THE INVENTION

A magnetic actuator generally includes a magnet, which may be a permanent magnet or an electromagnet, and a plunger. When an electromagnet is energized, a magnetic force acts on the plunger, for example drawing the plunger towards the electromagnet.

Magnetic actuators have a variety of applications. Hence, improvements in actuators, such as improved methods of increasing the magnetic force, are highly desirable.

SUMMARY OF THE INVENTION

Examples of the present invention include magnetic actuators in which the magnetic force is increased by focusing the magnetic field within at least one field focus region. An increased force, even with a small actuator volume, can be achieved by focusing the magnetic field at the air gap between the magnet body and the plunger. Here, the magnet body may be an electromagnet or a body including a permanent magnet. In the case of an electromagnet, the magnetic field may be focused using a near field plate (NFP, sometimes referred to as a near field focusing plate). The focused field produces a higher magnetic force acting on the plunger than an evenly distributed magnetic field.

Examples of the present invention use near field plates, supported by an electromagnet, which may be thin grating-like devices configured to focus electromagnetic radiation. A near field plate may be an impedance sheet having a modulated surface reactance. A near field plate may focus an electromagnetic field from a finite source (such as an electromagnet) on one side of the sheet to the other side with sub-wavelength resolution. This is the first time that near field plates have been applied in relatively low frequency electromagnetic actuator applications.

A near field plate or other focusing device may be located at the tip of an actuator electromagnet. Magnetic field focusing can be achieved within the air gap without appreciably modifying the magnetic reluctance. Assuming the reluctance is unchanged, the total magnetic flux produced by the electromagnet is maintained, so that focusing acts only to modify the field distribution. The flux concentration within a field focus region of the plunger end portion (where the magnetic field is focused) may be at least double the flux concentration within other regions of the plunger end portion. However, surprisingly, the focused field distribution produces a higher force acting on the plunger, even though the total flux is not changed. Hence, improved actuator performance is obtained using a focused magnetic field, compared with devices having a more evenly distributed field.

The near field plates may be configured for low frequency electromagnetic operation, for example a frequency of the order of kilohertz. For example, the electromagnetic frequency may be in the range 1 hertz to 100 kilohertz, more particularly 10 hertz through 50 kilohertz, and even more particularly 50 hertz through 20 kilohertz. Near field plates have not previously found applications at such low frequencies.

The magnet body may have a protruding portion comprising a magnetic material, having a tip. A magnetic field focusing device, such as a near field plate or shaped magnetic element, is attached at the tip, so that the magnetic field focusing device is located between the magnet body and the plunger.

The plunger may be elongated, having a first end proximate the near field plate or other magnetic focusing device, and a second end. An air gap exists between the magnetic field focusing device and the first end of the plunger, so that magnetic field lines extending from the electromagnet are focused by the magnetic field focusing device through the air gap to a central portion of the first end of the plunger. For example, a near field plate can be used to focus the magnetic field produced by an actuator electromagnet to a field focus region near a central location of the plunger, increasing the magnetic force. In some simulation results, the magnetic force increased by at least 100%, for example by 220%, when a magnetic field focusing device is attached to the tip, compared with an unfocused magnetic field.

An example actuator comprises an electromagnet having a magnet body and a coil wound around a portion thereof, and a plunger separated by a gap from the electromagnet, the plunger being moveable relative to electromagnet so as to vary the gap between them. The electromagnet produces a magnetic force on the plunger when the electromagnet coils are energized, as magnetic flux extends across the gap between an end portion of the electromagnet and an end portion of the plunger. A near field plate on the electromagnet end portion has a spatially modulated surface reactance configured to focus the magnetic flux at the end portion of the plunger, increasing the magnetic flux density within part of the plunger end portion and increasing the magnetic force on the plunger.

The magnetic flux may concentrated within a central region of the plunger end portion by the focusing action of a magnetic field focusing device such as a near field plate, which acts to converge magnetic flux lines within the gap between the electromagnet and the plunger. The plunger may be elongated along a central axis, for example having a cylindrical form, the magnetic field being concentrated by the near field plate near the central axis of the plunger. A magnetic field focusing device such as a near field plate may be configured so that focusing the magnetic flux at the end portion of the plunger at least doubles the magnetic force on the plunger.

The end portion of an electromagnet may have an end face, for example an end face generally normal to magnetic flux lines as they pass through the end face. A near field plate may cover some or all of the end face, and may be a generally planar element supported by the end portion of the electromagnet. In other examples, the near field plate may conform to a curved end face of the electromagnet.

An electromagnet coil may be energized by an alternating signal source having a signal frequency, for example in the range 50 Hz-100 kHz, such as in the range 100 Hz-1 kHz.

The plunger may be part of a plunger assembly, the plunger assembly including at least one spring configured to bias the plunger towards a rest position when the electromagnet coil is not energized, or magnetic force otherwise not applied to the plunger.

In some examples, an actuator may further including a ferrofluid located between the plunger and the magnet body so as to reduce the total reluctance of the flux path.

In some examples, a magnetic insulator covers at least a portion of the magnet body, the magnetic insulator having a material reluctance at least twice that of the magnet body, so as to reduce the flux leakage from the magnet body. Here, flux leakage may be considered magnetic flux that does not pass through both the magnet body and the plunger.

A method of increasing the magnetic force between the magnet body and plunger of a magnetic actuator comprises locating a magnetic field focusing device, such as a near field plate or shaped magnetic element, on the magnet body. For example, a near field plate may have a spatially modulated surface reactance configured so as to focus the magnetic flux within a region of the plunger, increasing the magnetic force between the electromagnet and plunger. In other examples, the magnetic force between a magnet body including a permanent magnet and moveable plunger may be increased using a shaped magnetic element, in particular a tapered magnetic element such as a cone or pyramid having a base attached to the magnet body and narrowed portion projecting towards the plunger. A shaped magnetic element may be part of a magnet body, or separate component attached thereto.

BRIEF DESCRIPTION OF THE FIGURES

FIG. 2B illustrates a novel modeling approach, in which optimization of a shaped element is used to determine the desired field profile.

FIGS. 3A and 3B further illustrate the focused field obtained using a near field plate, compared to an unfocused field.

FIGS. 9A and 9B illustrate normal and tangential field components as a function of degree of focusing.

FIG. 10 shows an electromagnetic actuator surrounded by a ferrofluid.

DETAILED DESCRIPTION OF THE INVENTION

Examples of the present invention include actuators in which a magnetic field focusing device is used to increase the magnetic force between a magnet body (such as an electromagnet or magnet body including a permanent magnet) and a moveable plunger. Examples of the present invention include an electromagnetic actuator having a near field plate attached at the tip of the electromagnet. The near field plate focuses the magnetic field at the air gap without appreciably modifying the magnetic reluctance. The flux produced by the electromagnet is hence maintained, and only its distribution is modified. In other examples, the magnetic field focusing device may be a shaped magnetic element, such as a tapered magnetic element, which may be used in actuators using either electromagnets or permanent magnets.

Figure 1:
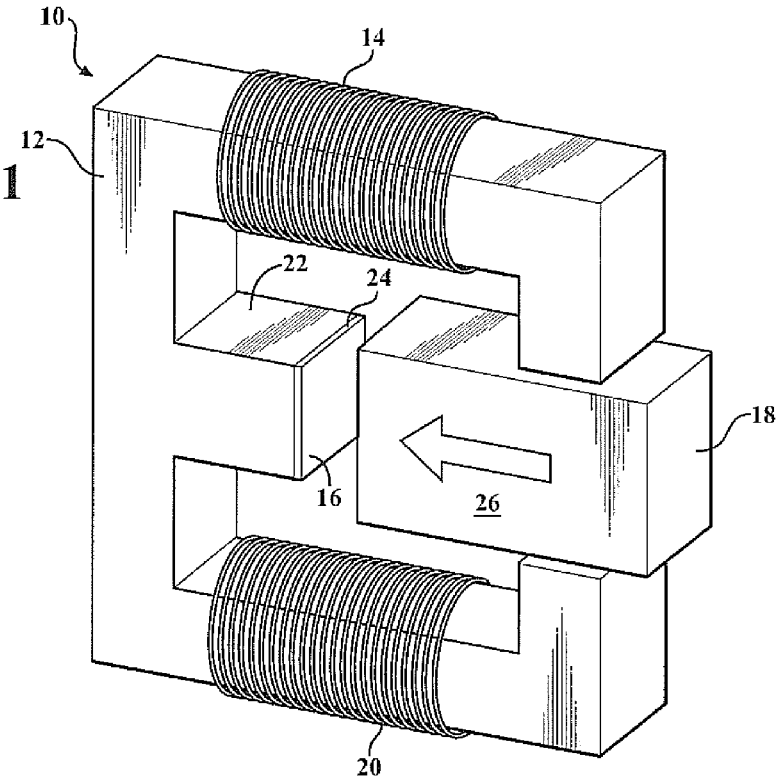
FIG. 1 shows an electromagnet having first and second coils, and a magnet body supporting a near field plate.

FIG. 1 shows a magnetic actuator 10 comprising an electromagnet. The electromagnet includes one or more coils such as 14 and 20 supported by the magnet body 12. The magnet body has a protruding portion 22 with a tip at 24. Near field plate 16 is supported at the tip 24.

When the coils are energized, magnetic flux extends between the electromagnet and the movable plunger 18. The plunger 18 has an end portion 26 proximate the electromagnet tip 24 and near field plate 16. A magnetic force is generated on the plunger when the coils are energized, and magnetic flux crosses the air gap between electromagnet and the plunger, which in this example tends to pull the plunger in the direction indicated by the arrow. The plunger is moveable relative to the electromagnet, and may be part of a plunger assembly including a spring for returning the plunger to a starting position when the coil is de-energized. For illustrative clarity, other actuator components are not shown.

The near field plate 16 focuses the magnetic flux towards a position within the center of the plunger, as described further elsewhere. Surprisingly, this increases the magnetic force on the plunger, allowing improved operation without having to use a larger electromagnet. A similar improvement is found using other magnetic field focusing devices, such as a tapered magnetic element, and also for actuators having a permanent magnet.

Figure 2A:
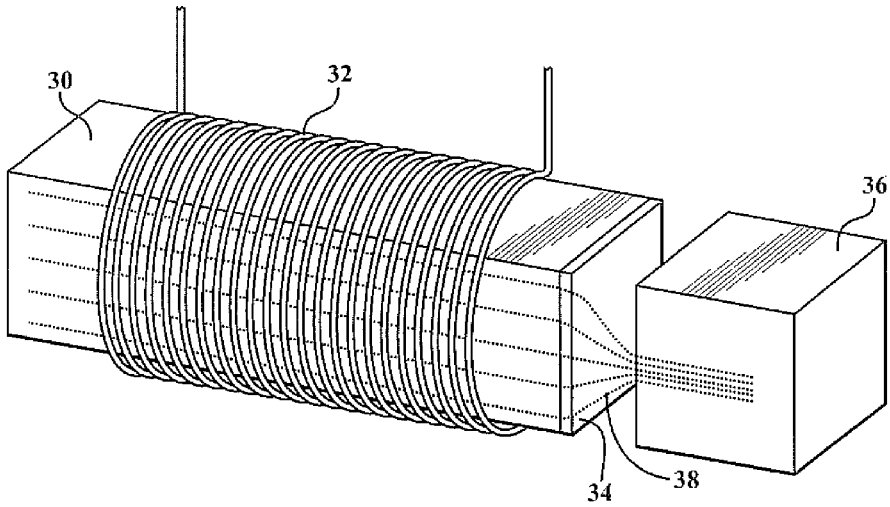
FIG. 2A shows a simplified electromagnetic actuator configuration, including a near field plate attached to the end portion.

FIG. 2A shows an electromagnetic actuator having a simpler configuration than that of FIG. 1, comprising an electromagnet formed by magnet body 30 and coil 32. A near field plate 34 is placed at the tip of the magnet body, so that magnetic flux induced when the coil is energized passes through magnet body 30, near field plate 34, and an air gap between the electromagnet and the plunger 36. Magnetic lines of flux are indicated as dotted lines in this figure, and the flux lines are focused after they pass through the near field plate, shown in the air gap 38. The magnetic field focusing generates a region of concentrated magnetic field near a central region of the plunger 36.

FIG. 2B illustrates a novel simulation approach for determining a desired field profile. In this model of the electromagnetic actuator of FIG. 2A, the magnetic field is produced by permanent magnet 40 embedded in the magnet body 30 (instead of the coil). The effect of field focusing is modeled using the shaped element 42. In this example, the tapered shaped element 42 simulates the focusing effect of the near field plate 34 in FIG. 2A. By optimizing the shape of element 42 (e.g. through adjusting the degree of taper to obtain an increased magnetic force on the plunger), an improved field profile is obtained. A near field plate can then be configured to produce the improved field profile, or a magnetic field focusing device configured using the shaped element found. For example, a magnetic field focusing device may be a three-dimensional shaped element having the cross-section shown in FIG. 2B (or otherwise obtained by optimization), for example a cone, truncated cone, pyramid, truncated pyramid, wedge, truncated wedge, other frustum, or the like.

FIGS. 3A and 3B are schematics further representing the effect of field focusing. FIG. 3A is similar to FIG. 2A, but lacking the near field plate shown at 34 in FIG. 2A. With no field focusing, the magnetic lines of flux (shown as thin lines) extend uniformly through magnet body 30 and in this case slightly diverge as they pass through the air gap 38 to plunger 36.

FIG. 3B represents the configuration of FIG. 2A, in which near field plate 34 focuses the magnetic lines of flux from electromagnet 30 so they are concentrated within a central portion of the plunger 36. Focusing of the magnetic field occurs through the air gap 38.

There is a concentration of magnetic lines of flux within an end of the plunger proximate the tip of the electromagnet. The tip of the electromagnet is that portion of the magnet body closest to the air gap between the electromagnet and the plunger.

To validate that a focused magnetic field increases the magnetic force on the plunger for the configuration of FIG. 1, a two-dimensional finite element analysis of the magnetic actuator was carried out.

Figure 4A:
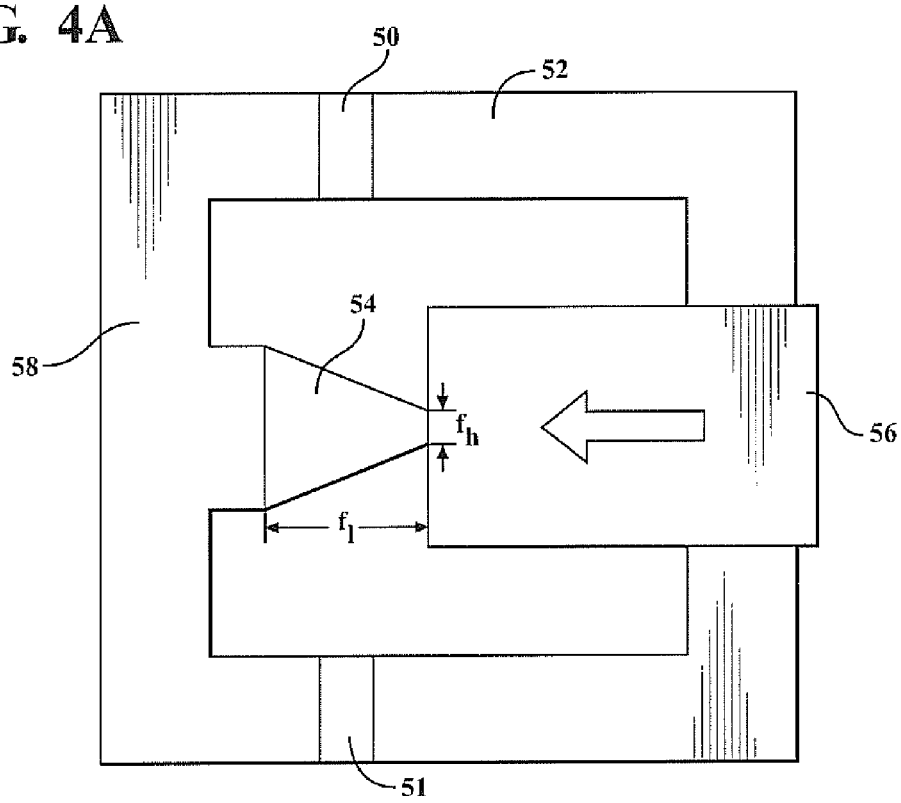
FIG. 4A shows a two-dimensional simulation model using a shaped element, used for estimating the increase in magnetic force on the plunger.

FIG. 4A shows the model geometry used in the simulation, comprising steel elements 52 and 58, permanent magnets 50 and 51, tapered element 54, and plunger 56. Air gaps are neglected in this simulation. The degree of magnetic field focusing is included within parameter $f_h$ shown in tapered shaped element 54, the width of the tip, where the base width and $f_l$ are both 1.5 cm. As $f_h$ decreases, the degree of magnetic field focusing increases. This configuration can be used to design improved electromagnetic actuators, in which a near field plate is configured to give the desired degree of magnetic field focusing. A field focusing parameter may be introduced in relation to a shaped element used to concentrate the magnetic field. For a tapered element such as a truncated cone or truncated pyramid, this may be defined as the ratio of the base width to the tip width. Preferably, the focus parameter is at least 2, such as at least 3, and in some examples at least 5. A focus parameter may correspondingly be defined in terms of an area ratio between the base area and tip area. In an actuator, an upper limit to the focus parameter may be that at which reluctance increase becomes significant.

This configuration can also be used to design improved magnetic actuators having a magnet body including a permanent magnet. An end portion of the magnet body may support a shaped magnetic element having a degree of narrowing or taper that achieves the desired magnetic field focusing. The magnet body itself may have a tapered end portion, or a separate tapered magnetic element may be attached to the magnet body.

FIG. 4A does not show the final actuator design, but represents the geometry used by a two-dimensional simulation to find an improved field distribution. Magnetic field focusing by the near field plate is simulated using the tapered shaped element. A permanent magnet replaces the solenoid coil to remove the geometrical effect of increased air-gap between the electro-magnet and plunger due to the tapered shape. In the simulation, the electromagnet is replaced with a permanent magnet (PM) producing a constant magnetic flux regardless of the reluctance.

A tapered shaped element may increase the magnetic reluctance in electromagnetic actuators and reduces magnetic flux produced by the electromagnet. This may impose a practical limit on the focus parameter of a tapered shaped element. However, a near field plate may be used to provide a focused field distribution without increasing the reluctance. Using a near field plate to achieve field focusing allows the total magnetic flux at the plunger to be retained, while modifying the field distribution to increase the magnetic force on the plunger. In other examples, a magnetic field focusing device having a similar form to the shaped element found by optimization can be used. For example, the magnetic field focusing device may comprise a tapered shaped magnetic element, such as a conical, pyramidal, frustoconical, or other tapered form having a cross-section that decreases along the direction extending from the magnet body to the plunger. The shaped element may be a truncated cone or pyramid, having a tip truncated by a plane parallel to the base. The shaped element may comprise a low reluctance material, in some examples having a lower reluctance than other electromagnet components. The shaped magnetic element may be a separate component supported by the magnet body, or may be integrated into the magnet body (for example, as a magnet body having a tip that is configured as the shaped element). The plunger end portion may present a generally planar face to the magnetic field focusing device, so that the lowest reluctance path for the magnetic flux is to remain within the shaped element until reaching the tip, at which point it crosses the gap to the plunger end portion.

Figure 4B:
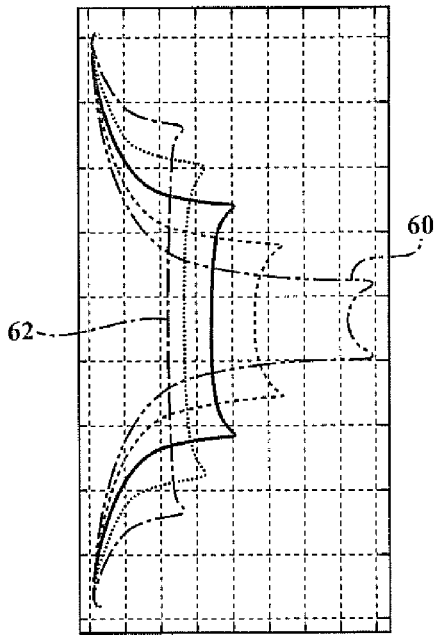
FIG. 4B shows the effect of shaped element configuration on the field distribution, used to simulate the effect of a near field plate.

FIG. 4B shows the magnetic field distribution as a function of $f_h$, where curve 60 represents a higher degree of focusing, and curve 62 represents a lower degree of focusing. For smaller $f_h$, the field is more concentrated near the center of the plunger. There may be a minimum practical value of $f_h$ determined by saturation properties of the materials used.

Figure 5A:
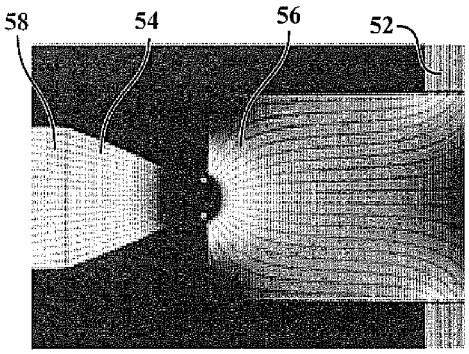
FIGS. 5A-5D show a number of field distributions, for various degrees of field focusing.
Figure 5B:
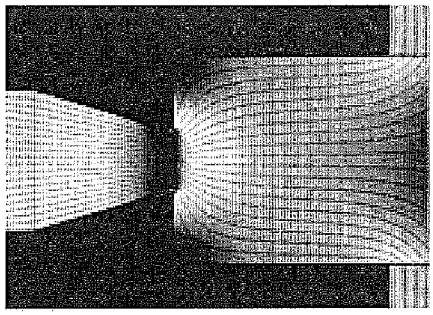
Figure 5C:
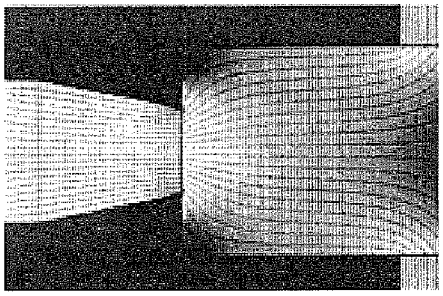
Figure 5D:
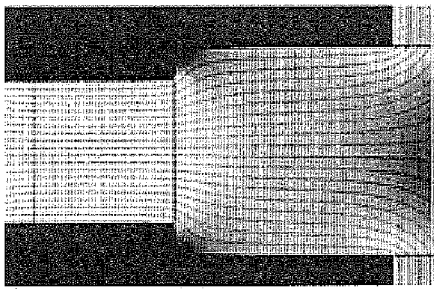

FIGS. 5A-5D illustrate the magnetic field distribution as a function of degree of focusing. The focusing is a maximum for the smaller degree of $f_h$. The degrees of focusing are represented by $f_h$ parameters 0.3, 0.6, 0.9, and 1.5 respectively (these were cm values in the simulation). In FIG. 5D, $f_h$=1.5 cm represents no focusing, the non-tapered shaped element corresponding to an absence of a near field plate or other magnetic field focusing device from the modeled device.

Figure 6:
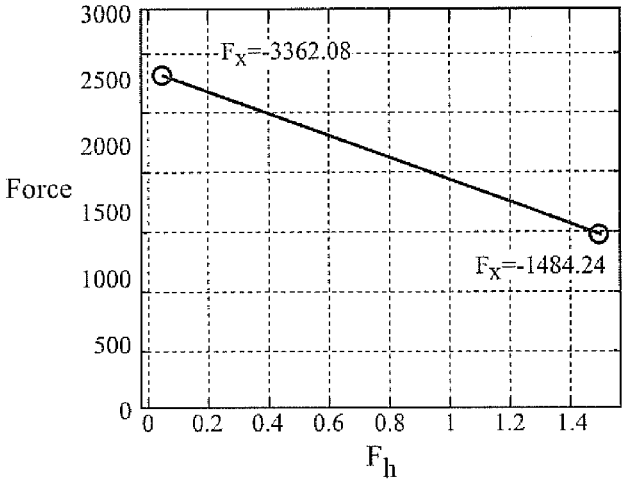
FIG. 6 illustrates an increase in magnetic force with field focusing.

FIG. 6 shows how the force on the plunger varies as a function of $f_h$. As shown, the force is significantly increased for higher degrees of focusing. For these data, a focused field distribution leads to a magnetic force increase of 126.5%.

The magnetic field distribution can further be optimized using finite element analysis. The aim is to find an optimal magnetic field distribution. In the simulation, field distribution is determined by the geometry of tapered element 54, which represents the effect of a magnetic field focusing device, such as a shaped magnetic element or a near field plate in the actuator.

Figure 7B:
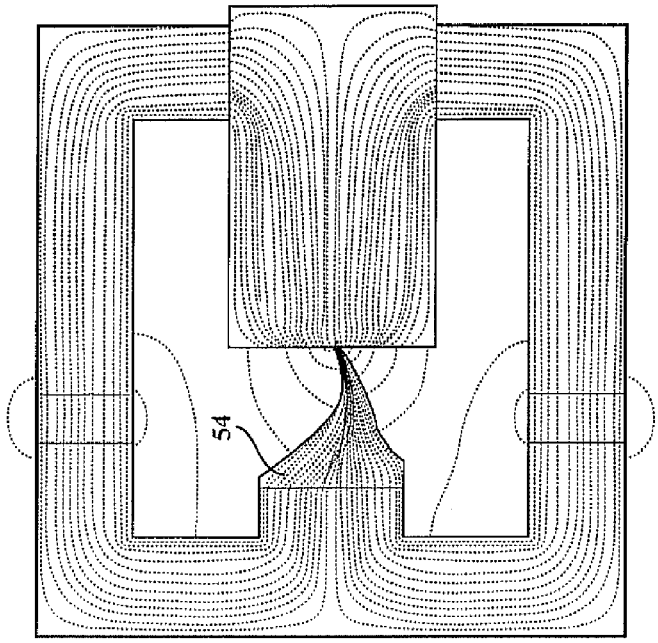
FIGS. 7A and 7B compare field distributions within the 2D model for focused and unfocused magnetic fields.
Figure 7A:
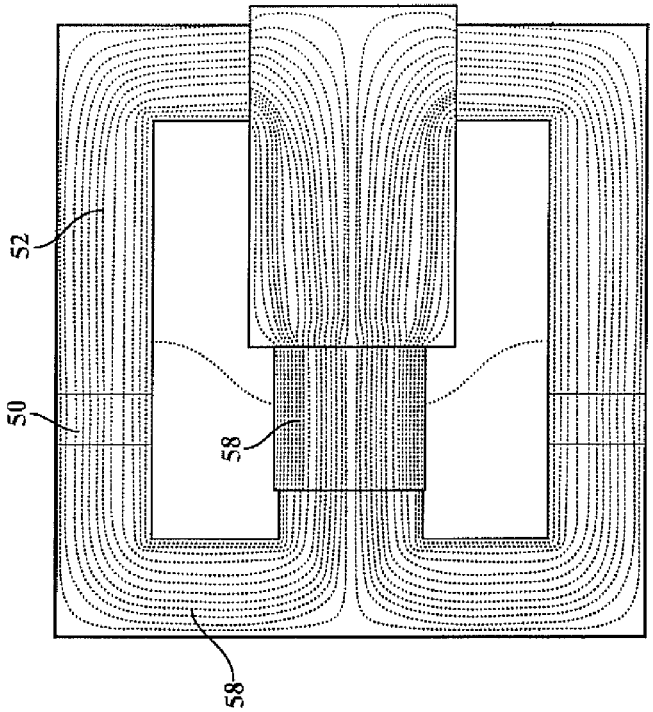

FIG. 7A shows the cross section of an actuator simulation similar to that of FIG. 4A, except that the shaped element is not optimized (shown at 58). This represents the case of no magnetic field focusing.

FIG. 7B shows a cross section similar to that of FIG. 4A, with an optimally tapered shaped element 54 as in FIG. 4A. This increases the magnetic field distribution at the central portion of the end of the plunger closest to the tapered element.

FIGS. 7A and 7B show magnetic lines of flux extending through magnetic elements of the simulation. As noted previously, the simulations use permanent magnets 50 to generate the magnetic lines of flux, so as to use the optimally shaped tapered element 54 to model the effect of the near field plate. This avoids the problems of reluctance increase when such a tapered element is used in an electromagnetic actuator.

Figure 8:
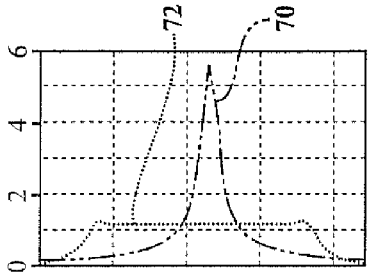
FIG. 8 illustrates an optimized focused field distribution.

FIG. 8 shows the degrees of focusing represented by field distributions for no near field plate 72, and an optimized focused field 70. As can be seen, the optimized focused field increases the magnetic flux density by a factor of greater than 2, and in this example greater than 3, compared with the absence of a near field plate.

Using the optimized focused field shown in FIG. 8, an increase in magnetic force of 220% was obtained. The magnetic force of configuration 7A was found to be 1,392 cN, whereas the magnetic force in configuration 7B was found to be 4,423 cN. This is a remarkable increase in magnetic force, which does not require generation of additional magnetic flux or modification of the size or shape of the plunger. This remarkable increase in magnetic force occurs due to the redistribution of flux lines induced by magnetic field focusing.

As previously discussed, the schematics FIGS. 7A and 7B represent a simulation of the effect of near field plates. In a fabricated device, a near field plate can provides the focused field generated by the tapered element used in the simulations, without introducing problems associated with increased reluctance of conventional tapered elements.

Magnetic Force Increase

FIGS. 9A and 9B show the normal and tangential components of the magnetic field as a function of increased degree of magnetic field focusing. As used here, the normal direction is a direction passing along the central axis of the plunger (e.g. along the direction of elongation of the plunger), and normal to the end face of the plunger. The tangential direction is orthogonal to the normal direction and extends across the end face of the plunger. The parameter $f_h$ is a distance along the tangential direction that has a maximum value of the cross-sectional diameter of the plunger (for a circular plunger). As $f_h$ decreases, the degree of focusing increases.

The reason for the higher force appears to be due to the fact that the force is calculated using an equation including square terms of magnetic flux density. Equation 1 below shows the magnetic force calculation using Maxwell stress tensor formulation:

$$F_s = \left[\frac{1}{\mu_0} B_n B_t\right] n + \left[\frac{1}{2\mu_0}(B_n^2 - B_t^2)\right] t \tag{1}$$

The surface force densities using the Maxwell stress tensor method may be calculated for an evenly distributed field and for a focused field in terms of normal and tangential field components. For an evenly distributed field, the field components are essentially constant across the plunger, and the force is evenly distributed. Magnetic field focusing increases the magnetic field values at some locations, and reduces the values at others. However, due to the presence of squared field terms in the force equation, the increased force at regions of higher magnetic flux more than compensates for the reduced force at regions of reduced flux, and overall the magnetic force increases.

Further, in a magnetic actuator, magnetomotive force is required to push the magnetic flux across the air gap. A focused field may find it easier to pass across the air gap, so that the presence of a focused field works as a reduced air gap in the device.

Hence, using a near field plate increases the magnetic force on the actuator, while avoiding geometric effects to shaped elements in the electromagnet. A near field plate or other magnetic field focusing device may be used to obtain two-dimensional focusing, in which the field is concentrated along a line across an end face of the plunger, or three-dimensional focusing in which the field is concentrated around a point within the end portion of the plunger. The region of focused field may have any desired shape.

Ferrofluids

Another approach to increasing magnetic force is to submerge the actuator in a ferrofluid, or otherwise introduce a ferrofluid into the gap between the electromagnet and the plunger. A ferrofluid is a liquid that can be magnetized, and may comprise magnetic particles, such as nanoparticles, suspended in a liquid medium. The permeability of ferrofluid is higher than that of air, and reducing the total magnetic reluctance of the overall flux path in the apparatus. Hence use of a ferrofluid allows a stronger magnetic field to be produced by the electromagnet. When a magnetic actuator is submerged in a ferrofluid, the stronger magnetic field at the air gap produces a higher magnetic force.

FIG. 10 shows an electromagnet comprising body 30 and coil 32 and plunger 36, in a configuration similar to that shown in FIG. 2. In this example, the electromagnet and plunger are submerged in ferrofluid 100. The ferrofluid may be localized around the air gap between the plunger and the electromagnet, and configured so that the ferrofluid is not appreciably compressed as the plunger approaches the electromagnet. This approach may also be used for permanent magnet based actuators.

The configuration of FIG. 10 was modeled using a finite element model. In the model, the air gap of a conventional actuator was replaced by a ferrofluid. Using a ferrofluid, a significantly stronger magnetic field was produced. For example the relative permeability of air is 1.0, and that of the ferrofluid may be 4.0. The high permeability ferrofluid allows a huge increase in magnetic force on the plunger, and the force is expected to increase in a generally linear fashion as the permeability of the ferrofluid increases.

Hence, the performance of a magnetic actuator using a near field plate or other magnetic field focusing device may be further enhanced by the introduction of a ferrofluid into the gap between the electromagnet (or magnet body including a permanent magnet) and the plunger. Other fluids having a permeance appreciably greater than air, such as at least one or two orders of magnitude greater, may be used.

Magnetic Insulator

Another approach to increasing the magnetic force on the plunger is to use a magnetic insulator. When the electromagnet is surrounded in whole or in part by a magnetic insulation device, the magnetic field flows to the end of the electromagnet without side leakage. This makes the magnetic field within the air gap stronger, leading to a higher magnetic force.

Figure 11:
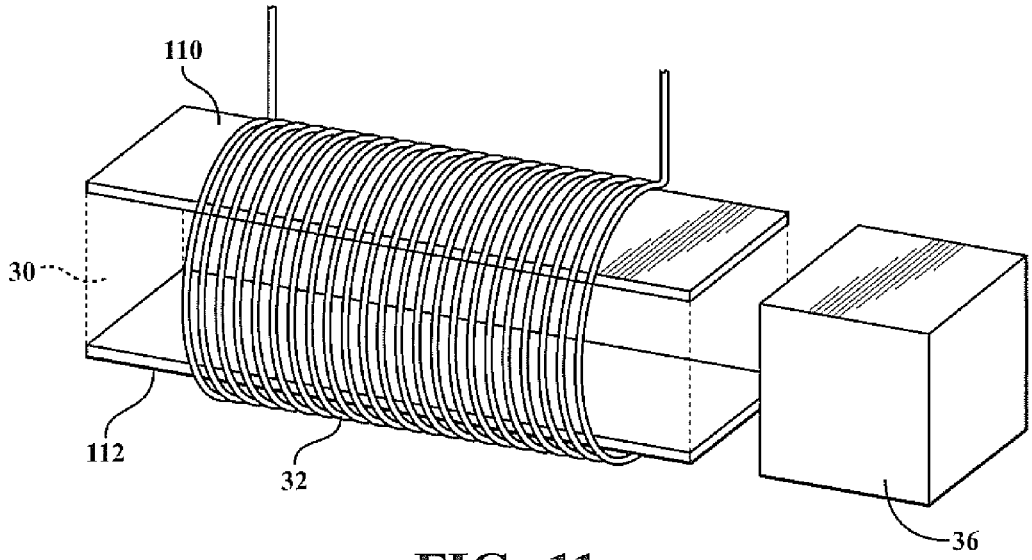
FIG. 11 shows an electromagnetic actuator in which magnetic insulation is applied to the electromagnet portion.

FIG. 11 shows an example configuration, with the components as shown and described in relation to FIG. 2, along with the addition of magnetic insulation at the top and bottom of the electromagnet, at 110 and 112. This approach may also be used for permanent magnet based actuators.

A finite element model was created to simulate the effect of the magnetic insulator, such as shown in FIG. 11. The magnetic insulator comprises a material having a lower permeability than that of the magnet body. The magnet body was modeled as steel. The simulation showed that in the absence of a magnetic insulator, there was a great deal of flux leakage through the sides of the magnet body that did not pass through the air gap. In contrast, when the magnetic insulator was introduced, the insulator prevented flux leakage and increased the magnetic field flux density at the air gap, hence increasing the magnetic force on the plunger. Simulations showed that a perfect magnetic insulator would lead to a huge increase of magnetic force, but many magnetic insulation materials allow a significant increase in magnetic force to be obtained. For example, a magnetic insulation material may have a reluctance at least double that of the body of the electromagnet, and in some examples the reluctance may be at least an order of magnitude greater.

Hence, the performance of a magnetic actuator using a near field plate or other magnetic field focusing device may be further enhanced by providing a magnetic insulator around at least a portion of the electromagnet. The magnetic insulator may cover some or all of the body of the electromagnet, and the coil(s), so as to reduce escape of magnetic flux from the electromagnet before the flux passes through the near field plate, gap, and plunger.

Test Bench

Figure 12:
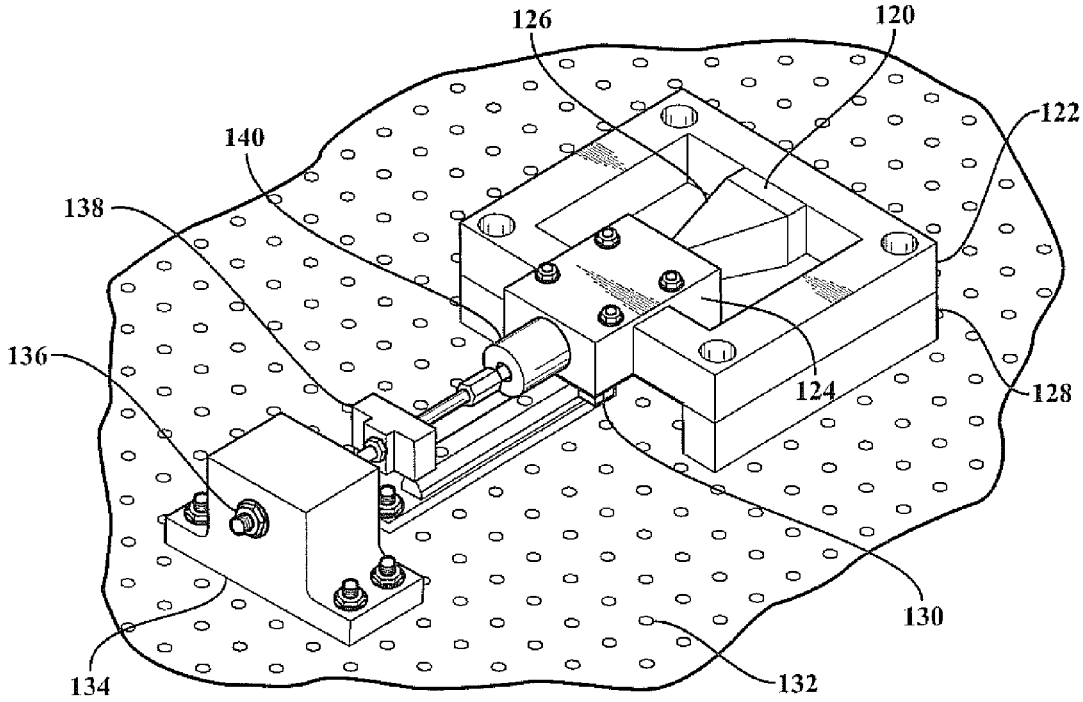
FIG. 12 shows test bench designed to evaluate the performance of the field focusing concept

FIG. 12 shows test bench designed to evaluate the performance of the field focusing concept, comprising permanent magnet 120, magnet body (yoke) 122, plunger 124 which travels on the linear bearing 130, shaped element (field focusing portion of the yoke) 126, standoff 128 spacing the yoke from the optical bench breadboard 132, ground block 134, gap adjustment nut 136, load cell 138, and alignment coupler 140.

The test bench allows the effect of field profiles on magnetic force on the plunger to be determined, through modification of the shaped element 126. The results can be used to test and improve simulation results.

Near Field Plates

The near field plate may be a patterned, grating-like plate having sub-wavelength features. The near field plate may comprise capacitive elements, a corrugated surface, or other configuration, such as those described by Grbic and coworkers. Near field plates may focus electromagnetic radiation to spots or lines of arbitrarily small subwavelength dimensions.

Near field plates used in examples of the present invention include devices such as those described by Grbic and coworkers. However, previous discussions of such near field focusing plates have concentrated on high frequency applications, where the diffraction limit is a problem to be overcome. The present invention uses such near field plates to achieve focusing of low frequency (for example kilohertz) frequency electromagnetic signals used in electromagnetic devices such as actuators.

The design and configuration of example near field plates is described in detail in the following references: Imani and Grbic, "Near-field focusing with a corrugated surface", IEEE Antennas and Wireless Propagation Letters, Vol. 8, 2009; Grbic et al., "Near-field plates: subdiffraction focusing with patterned surfaces", Science, Vol. 320, 2008; Grbic and Merlin, "Near-field focusing plates and their design", WEE Trans. on Antennas and Propagation, Vol. 56, 2008; and US2009/0303154 to Grbic et al.

In examples of the present invention, the use of a near field plate is not suggested by any recognized need to overcome a diffraction limited focusing problem. A near field plate is used to modify the magnetic field distribution at a movable plunger to achieve a greater magnetic force on the plunger.

A near field plate may comprise patterned conducting elements (such as wires, loops, corrugated sheets, capacitive elements, inductive elements, and/or other conducting elements) formed on or otherwise supported by a dielectric substrate. An example near field plate has a surface impedance with sub-wavelength structure. The surface impedance structure, and hence pattern of conducting elements, may be determined using back-propagation methods from the desired field focusing properties, for example as described by US2009/0303154 to Grbic et al. A near field plate may include grating-like sub-wavelength structures. Other structures include a circular corrugated surface, such as a grooved surface with a radial profile in the form of a Bessel function. Focusing may be two-dimensions (e.g. focused about a line) or three dimensional (e.g. focused around a point within the end portion of the plunger)

The near field plate may be generally planar, or in other examples may be curved to conform to a surface (e.g. a curved or other non-planar end surface of an electromagnet).

Novel Method of Optimizing Field Distribution

An example method of improving the operation of an actuator is to determine an optimized field profile to increase the magnetic force on the movable element of the actuator (herein referred to as the plunger), and then to design a near field plate so as to obtain the optimized field profile. The optimized field profile is determined by modeling the effect of the near field plate using a shaped magnetic element, and then optimizing the shape of the element.

Simulations can be used to determine the magnetic current density on the plate required to produce the desired magnetic field focusing. Even if optimized field profiles are not used, even slightly suboptimal fields allow surprisingly high increases in magnetic force within electromagnetic actuators.

FURTHER ASPECTS

Examples of the present invention include magnetic actuators having one or more of the following features: a near field plate or other means for focusing the magnetic field at the air gap; a ferrofluid located between the electromagnet and the plunger, so that the air gap no longer is an air gap but instead is filled with ferrofluid; and the use of a magnetic insulator to prevent leakage of magnetic flux out of the magnet body of the electromagnet before the flux reaches the air gap or other gap between the electromagnet and the plunger.

In various examples, the term "air gap" is used for the gap between the electromagnet and the plunger. However, in other examples, the gap may include another material, such as a ferrofluid.

Examples of the present invention include magnetic devices, such as actuators, in which a focused field distribution is used to obtain improved magnetic force properties. For example, higher actuating forces may be obtained by focusing the magnetic flux within a gap between, for example, a stationary element such as the electromagnet, and a moving element such as a plunger, using a magnetic field focusing device. This device may be, for example, a shaped magnetic element or near field plate.

A magnetic field focusing device may act to concentrate the magnetic flux within one or more regions proximate an end portion of the magnet body. This may be the electromagnet end portion when the electromagnet coil is energized, or a magnet body including a permanent magnet. The regions of concentrated magnetic flux may be located at or within the end portion of a plunger.

Example actuators may have outer dimensions (such as the width and height of the two dimensional representations above) in the range 1 cm-20 cm. The depth may be in the range 1 cm-5 cm. These dimensions are exemplary and non-limiting.

A method of increasing the actuating force of an actuator includes attaching a magnetic field focusing device, such as a shaped magnetic element or near field plate, to the end portion of the magnet body, such as an electromagnet.

The invention is not restricted to the illustrative examples described above. Examples described are not intended to limit the scope of the invention. Changes therein, other combinations of elements, and other applications will occur to those skilled in the art.

Having described our invention, we claim:

1. An actuator comprising:

a magnet body having a magnet end portion, the magnet end portion including a near field plate supported by the magnet end portion; and a plunger, moveable relative to the magnet end portion, the plunger having a plunger end portion:

the magnet body producing a magnetic force on the plunger induced by magnetic flux extending through a gap between the magnet end portion and the plunger end portion, the near field plate increasing magnetic flux density within a region of the plunger end portion, increasing the magnetic force on the plunger and wherein the near field plate bends the magnetic flux at an angle and then concentrates the magnetic flux near the center of the plunger.

2. The apparatus of claim 1, the magnet body being an electromagnet having a coil wound around a portion of the magnet body.

3. The apparatus of claim 1, the magnet body including a permanent magnet.

4. The apparatus of claim 1, the magnetic field focusing device acting to converge magnetic flux lines within the gap between the magnet end portion and the plunger end portion, so as to at least double the magnetic flux density within the region of the plunger end portion.

5. The apparatus of claim 1, the plunger being elongated along a central axis, the region being located proximate the central axis of the plunger.

6. The apparatus of claim 3, the plunger being generally cylindrical.

7. The apparatus of claim 1, the magnetic field focusing device being configured so as to at least double the magnetic force on the plunger.

8. The apparatus of claim 1, the magnetic field focusing device being a shaped form, the shaped form being a tapered magnetic element having a base supported by the magnet end portion.

9. The apparatus of claim 8, the tapered magnetic element being a truncated cone or truncated pyramid having a base attached to the magnet body and a tip facing the plunger end portion across the gap, the tapered magnetic element having a ratio of base width to tip width of at least 2:1.

10. The apparatus of claim 1, the magnet body being an electromagnet having a coil wound around an portion of the magnet body, the magnetic field focusing device being a near field plate supported by the electromagnet end portion, the near field plate having a spatially modulated surface reactance configured so as to increase the magnetic flux density within the end portion of the plunger.

11. The apparatus of claim 10, the near field plate being a generally planar element supported by the end portion of the magnet body.

12. The apparatus of claim 10, the coil being energized by an alternating signal source having a signal frequency, the signal frequency being in the range 50 Hz-100 kHz.

13. The apparatus of claim 12, the signal frequency being in the range 100 Hz-1 kHz.

14. The apparatus of claim 1, further including a ferrofluid located within the gap between the plunger end portion separated and the electromagnet end portion.

15. The apparatus of claim 1, further including a magnetic insulator covering a portion of the magnet body, the magnetic insulator having a magnetic reluctance at least twice that of the magnet body.

16. The apparatus of claim 1, the plunger being part of a plunger assembly, the plunger assembly including at least one spring.

17. An actuator comprising:

an electromagnet, including a magnet body and a coil wound around a portion of the magnet body, the magnet body having a magnet end portion;

a plunger having a plunger end portion separated from the magnet end portion by a gap, the plunger being moveable relative to the magnet end portion, the electromagnet producing a magnetic force on the plunger when the coil is energized, the magnetic force being induced by magnetic flux extending through the gap between the magnet end portion and the plunger end portion, a near field plate supported by the magnet end portion increasing the magnetic flux density within a field focus region of the plunger end portion, increasing the magnetic force on the plunger and wherein the near field plate bends the magnetic flux at an angle and then concentrates the magnetic flux near the center of the plunger, the near field plate being a generally planar element having a spatially modulated surface reactance.

* * * * *